United States Patent [19]

Ziemer

[11] Patent Number: 4,867,862

[45] Date of Patent: Sep. 19, 1989

[54] PROCESS FOR HYDRODEHAZING HYDROCRACKED LUBE OIL BASE STOCKS

[75] Inventor: James N. Ziemer, Hercules, Calif.

[73] Assignee: Chevron Research Company, San Francisco, Calif.

[21] Appl. No.: 40,459

[22] Filed: Apr. 20, 1987

[51] Int. Cl.[4] ..... C10G 65/12

[52] U.S. Cl. ..... 208/27; 208/33; 208/58; 208/59; 208/95; 208/96; 208/97; 208/99

[58] Field of Search ..... 208/58, 87, 57, 33, 208/18, 27, 39, 97, 96, 99; 502/67, 527

[56] References Cited

U.S. PATENT DOCUMENTS

| | | | |
|---|---|---|---|
| 3,617,476 | 11/1971 | Woodle | 208/96 |
| 3,730,876 | 5/1973 | Sequeira, Jr. | 208/18 |
| 3,894,937 | 7/1975 | Bonnacci et al. | 208/58 |
| 3,923,636 | 12/1975 | Mead et al. | 208/58 |
| 4,181,598 | 1/1980 | Gillespie et al. | 208/18 |
| 4,269,695 | 5/1981 | Silk et al. | 208/46 |
| 4,283,271 | 8/1981 | Garwood et al. | 208/59 |
| 4,325,805 | 4/1982 | Miller | 208/59 |
| 4,347,121 | 8/1982 | Mayer et al. | 208/58 |
| 4,363,719 | 12/1982 | Bousquet et al. | 208/58 |
| 4,414,097 | 11/1983 | Chester et al. | 208/95 |
| 4,574,043 | 3/1986 | Chester et al. | 208/97 |
| 4,597,854 | 7/1986 | Penick | 208/109 |
| 4,601,996 | 7/1986 | Miller | 208/143 |
| 4,605,488 | 8/1986 | Chester et al. | 208/97 |
| 4,622,130 | 11/1986 | Stem | 208/33 |
| 4,627,908 | 12/1986 | Miller | 208/18 |
| 4,657,661 | 4/1987 | Miller | 208/143 |
| 4,673,487 | 6/1987 | Miller | 208/58 |
| 4,678,556 | 7/1987 | Hicks et al. | 208/96 |

*Primary Examiner*—Anthony McFarlane

*Attorney, Agent, or Firm*—T. G. De Jonghe; V. J. Cavalieri

[57] ABSTRACT

I disclose a single stage, multilayered catalyst system capable of hydrodehazing and hydrofinishing a solvent dewaxed lube oil base stock. In the first layer, I catalytically dewax the solvent dewaxed stock. In the second layer, I hydrofinish the catalytically dewaxed stock. My invention also relates to a process for hydrodewaxing and hydrofinishing a solvent dewaxed lube oil base stock.

9 Claims, No Drawings

PROCESS FOR HYDRODEHAZING HYDROCRACKED LUBE OIL BASE STOCKS

BACKGROUND OF THE INVENTION

The present invention relates to a single stage, multilayered catalyst system for hydrodehazing and hydrofinishing a hydrocracked, solvent dewaxed lube oil base stock. In the first layer, the hydrocracked, solvent dewaxed stock is catalytically dehazed, using, for example, a high constraint index aluminosilicate zeolite catalyst. In the second layer, the catalytically dewaxed stock is hydrofinished using, for example, a palladium hydrotreating catalyst having an alumina or siliceous matrix.

This invention also relates to a process for hydrodehazing and hydrofinishing a hydrocracked, solvent dewaxed lube oil base stock. The process comprises contacting the base stock with hydrogen in the presence of the multilayered catalyst system. Specifically, I have found that by using high space velocity rates and a high hydrogen partial pressure, both hydrodehazing and hydrofinishing are accomplished in a single process step using the layered catalyst system with minimum yield, VI, and pour point loss.

It is well known in the art to form various lubricating oils from hydrocarbon fractions derived from petroleum crudes. The process of refining to isolate a lubricant base stock consists of a set of unit operations to remove or convert the unwanted components. They may include, for example, distillation, hydrocracking, dewaxing, and hydrogenation.

It often occurs in the course of refining a lube oil that a product is made to specification except for some deficiency resulting from contamination by a small amount of high melting wax. For example, a refined oil may be prepared that has a satisfactory pour point and cloud point, but upon storage, a wax haze develops that makes the oil commercially unacceptable.

When this haze occurs, the refiner suffers a severe economic penalty because the haze is usually discovered only after all the raw material and process costs have been expended to make the product. At this time, there is no effective and economic process to remove the small amounts of contaminating wax, present in amounts less than 2.0 weight percent. These contaminated oils generally cannot be mixed with other oils to make a commercially acceptable blend. Thus, there is no market or use for these contaminated oils other than feeding them to a catalytic cracking unit or burning them as heavy fuel oil.

In recent years, workers in the field have proposed various processes to catalytically dewax petroleum oils. For example: U.S. Pat. No. 3,755,138 (hydrodewaxing intermediate pour point solvent dewaxed lube oils for further pour point reduction); U.S. Pat. No. 4,181,598 (catalytic dewaxing, followed by hydrofinishing of solvent refined lube oils to produce low pour point, high stability lube oils); and U.S. Pat. No. 4,269,695 (catalytic hydrodewaxing of poorly dewaxed lube oils over a zeolite catalyst). In addition, U.S. Pat. No. 4,597,854 describes a multi-bed dewaxing process. But none of these patents describes a single stage, multilayered catalyst system for hydrodehazing and hydrofinishing a hydrocracked, solvent dewaxed lube oil base stock.

Because of high fluctuations in sulfur and nitrogen levels, all of these processes require relatively low liquid hourly space velocities (LHSV), less than 4 hr.$^{-1}$.

Furthermore, if the constraint index of the zeolite catalyst is too low, a further economic penalty will result from base oil yield losses in attempting to remove traces of wax. Moreover, if dehazing is done after hydrofinishing, the oxidation stability of the lube oil may be affected. So as a practical result, the catalytic dehazing must be accomplished separately from other processes such as hydrofinishing. Accordingly, it is the principal object of this invention to accomplish both catalytic dehazing and hydrofinishing in a single process step. This is accomplished at a relatively high LHSV and high hydrogen partial pressure in order to combine both processes.

It has now been discovered that by using a multilayered catalyst system, an LHSV greater than 4 hr.$^{-1}$, with respect to the dehazing catalyst and hydrogen partial pressure greater than 500 psia, hydrocracked, solvent dewaxed lube oil base stocks can be catalytically dehazed and hydrofinished in a single process step. Thus, the present invention yields increased process efficiencies and reduced capital costs.

SUMMARY OF THE INVENTION

The invention concerns a multilayer, single stage catalyst system capable of hydrodewaxing and hydrofinishing a hydrocracked solvent dewaxed lube oil base stock. The system comprises two catalyst layers. The first layer comprises a fixed bed of catalyst particles having a zeolite based dewaxing catalyst with a pore probe selectivity greater than 4; the second layer comprises a fixed bed of catalyst particles having hydrogenation activity under mild conditions.

In accordance with this invention, a process is disclosed for dehydrowaxing and hydrofinishing a hydrocracked solvent dewaxed lube oil base stock using the multilayered catalyst system. The process comprises passing the stock, in the presence of hydrogen, through the first and second layers of catalyst particles at hydroprocessing conditions.

In a preferred embodiment, the hydroprocessing conditions comprise an LHSV greater than 4 with respect to dewaxing catalyst and a hydrogen partial pressure ranging from about 1000 psia to about 2500 psia.

DETAILED DESCRIPTION OF THE INVENTION

The hydrocarbonaceous feeds, from which I obtain the hydrocracked lube oil base stocks used in the process of this invention, usually contain aromatic and naphthenic compounds as well as normal and branched paraffins of varying chain lengths. These feeds usually boil in the gas oil range. I prefer feedstocks such as hydrocracked vacuum gas oils (VGO) with low viscosity indexes (VI) and normal boiling ranges above about 350° C. and below about 600° C., and deasphalted hydrocracked residual oils having normal boiling ranges above about 480° C. and below about 650° C. I can also use hydrocracked reduced topped crude oils, shale oils, liquefied coal, coke distillates, flask or thermally cracked oils, atmospheric residua, and other heavy oils as the feed source, so long as the total nitrogen level is below 50 ppm.

Typically, I hydrocrack the hydrocarbonaceous feed, preferably VGO, using standard reaction conditions and catalysts in one or more reaction zones. The resulting hydrocracked lube oils are low in multi-ring aromatic and naphthenic molecules, and have a VI greater than 95. In addition, such oils are low in sulfur, less than 20 ppm, and nitrogen, less than 20 ppm.

Next, I solvent-dewax the hydrocracked base stock to a pour point of less than 15° F., using conventional solvent dewaxing procedures and apparatus. Suitable solvents include, for example, methyl ethyl ketone and toluene. The lube oil base stock preferably less than 2.0 wt. % wax, less than 20 ppm nitrogen and less than 20 ppm sulfur.

In the present process, I contact the hydrocracked, solvent dewaxed base stock with a multilayered catalyst system, in the presence of hydrogen, at a high LHSV and at high hydrogen partial pressure. The first catalyst layer in the system comprises a zeolite based dehazing catalyst with a pore probe selectivity greater than 4 and the second catalyst layer comprises a hydrofinishing catalyst.

I select suitable molecular sieve based dehazing catalysts from conventional catalytic dewaxing processes. For example, suitable crystalline aluminosilicate zeolites or silica aluminophosphate sieves include such materials as ZSM-22 (Valzocsik, U.S. Pat. No. 4,481,177; and Zones, U.S. Pat. No. 4,483,835), ZSM-23 (U.S. Pat. No. 4,076,842), and non-zeolitic molecular sieves such as SAPO-11 (Lok et al., U.S. Pat. No. 4,440,871). Of particular importance is my selection of a catalyst that has a high selectivity for normal paraffins over branched paraffins as reflected by its ratio of absorbed normal paraffins to adsorbed isoparaffins in a pore probe test.

The Pore Probe test is described in 99 *J. Cat.* 335–41 (1986), herein incorporated by reference. The pore probe technique allows us to measure the absolute concentrations of molecules in zeolite pores at temperatures near reaction conditions. In general, the greater the ratio of normal paraffin to isoparaffin, as measured by milligrams of hydrocarbon to grams of zeolite, in the zeolite pore system, the higher the selectivity. In the present process, I can use catalysts having a ratio of normal hexane to combined 3-methylpentane and 2,2-dimethylbutane of greater than 4, preferably ranging from about 15 to about 70, as measured at 240° C.

Table I lists some representative zeolites along with their pore probe results.

TABLE I

| | milligrams absorbed hydrocarbon/grams zeolite | | | |
|---|---|---|---|---|
| catalyst | n-hexane | 3-methyl-pentane | 2,2-dimethyl-butane | Ratio normal/iso |
| ZSM-5 | 41 | 11 | 4.4 | 2.7 |
| ZSM-23 | 44 | 2 | 0.2 | 20 |
| ZSM-22 | 12 | 0.2 | 0 | 60 |
| SAPO-11 | 11 | 1.6 | 0.6 | 5 |

In the second layer of the catalyst system, I hydrofinish the catalytically dewaxed stock using a mild hydrogenation catalyst. I select suitable catalysts from conventional hydrofinishing catalysts having hydrogenation activity. Because I hydrofinish under relatively mild conditions, I prefer to use a less active hydrogenation catalyst. For example, a noble metal from Group VIIIA according to the 1975 rules of the International Union of Pure and Applied Chemistry, such as palladium, on an alumina or siliceous matrix, or unsulfided Group VIIIA and Group VIB, such as nickel-molybdenum or nickel-tin, is a suitable catalyst. U.S. Pat. No. 3,852,207 granted Mar. 26, 1973, to Stangeland et al., describes a suitable noble metal catalyst and mild conditions, and is herein incorporated by reference. Other suitable catalysts are detailed, for example, in U.S. Pat. Nos. 4,157,294 and 3,904,513.

In an alternative embodiment, the molecular sieve dewaxing catalyst component may be used with a hydrogenation component. The hydrogenation component may be a metal from Group VIII of the Periodic Table of Elements or a mixture of such metals alone or in combination with a metal from Group VI of the Periodic Table of Elements or a mixture thereof.

Typical hydrodehazing and hydrofinishing conditions which I found useful in the present process vary over a fairly wide range. In general, the overall LHSV is about 0.25 to about 2.0, preferably about 0.5. The specific hydrodehazing LHSV is greater than 4 $hr.^{-1}$, preferably from about 10 $hr.^{-1}$ to about 15 $hr.^{-1}$; hydrogen partial pressure is greater than 500 psia, preferably ranging from about 1000 psia to about 2500 psia; temperatures range from about 550° F. to about 650° F., preferably from about 580° F. to about 600° F.; pressures range from about 500 psig to about 3000 psig, preferably from about 1500 psig to bout 2500 psig; and hydrogen circulation rate range from about 3000 SCF/bbl to about 15,000 SCF/bbl, preferably ranging from about 5000 SCF/bbl to about 7000 SCF/bbl.

The advantage of using a high LHSV in the present invention is that it allows us to use dehazing and hydrofinishing catalysts in the same reactor at identical conditions. This advantage is especially enhanced when both hydrofinishing and dehazing layers of catalyst are in physical contact with each other. Because hydrofinishing catalysts normally require higher operating temperatures than conventional dehazing catalysts, I require a dehazing catalyst with high selectivity for removal of trace wax components so that excessive losses due to base oil cracking are not incurred. In particular, the selectivity of the dehazing catalyst must be high enough so that temperature changes in excess of 100° F. over the lifetime of the hydrofinishing catalyst does not incur concomitant losses in base oils from lower fouling rate dewaxing catalysts. Thus, I can recharge both layers of catalysts simultaneously and, therefore, efficiently use them in the same process step.

Moreover, in the present invention, I hydrodehaze and hydrofinish without altering the physical properties of the lube oil base stock. Because the hydrocracked stock contains relatively low levels of nitrogen and sulfur, little catalyst poisoning occurs. Thus, I can use a dehazing catalyst, with a pore probe selectively greater than 4, under mild conditions. By subjecting the stock to such mild conditions, I noticed no appreciable change in viscosity, VI, or pour point and less than 3.0% loss in yield with respect to the hydrofinishing catalyst alone.

I exemplify below these advantages, as well as other advantages of the present invention. I intend the examples to illustrate representative embodiments of the invention and results which I have obtained in laboratory analysis. Those familiar with the art will appreciate that other embodiments of the invention will provide equivalent results without departing from the essential features of the invention.

EXAMPLES

I used two catalysts in the tests described hereinafter. I identify them as Catalysts A and B.

Catalyst A, a dehazing catalyst, comprised of 65% HZSM-22 with an $SiO_2/Al_2O_3$ ratio of 85:1 and with 35% alumina binder in the form of crushed extrudate sized from 18 to 42 mesh. Details of preparing it are disclosed in U.S. Pat. No. 4,483,835 to Zones, issued Nov. 20, 1984, which is incorporated by reference.

Catalyst B, a commercial hydrofinishing catalyst, comprised 0.6 wt. % platinum on a $SiO_2$:$Al_2O_3$ base in the form of crushed extrudate sized from 18 to 42 mesh. Details of preparing it are disclosed in U.S. Pat. No. 4,162,962 to Stangeland, issued July 31, 1979, which is incorporated by reference.

In the tests that follow, I used an analytical test for gauging the performance of the catalyst system.

The "NTU Index" is a Chevron-developed, quantitative test for the wax remaining in heavy neutral oil after solvent dewaxing. Residual wax is precipitated by solvent and quantitated by nephelometric turbidity. Results from the test are reported in Nephelometric Turbidity Units (NTU) and correlate quite well with the visual appearance of hydrofinished oils stored at room temperature. Based on the appearance of reference oils, the maximum turbidity rating allowable for commercial oils is 24. Gas chromatographic analysis of the isolated material shows characteristics similar to refined waxes made from waxy heavy neutral.

The NTU test relies on the precipitation of wax upon addition of 50° F. methyl ethyl ketone (MEK). Visual inspection can distinguish qualitatively between amounts of wax in the MEK/oil solution, but quantitation requires that the wax be separated by filtration from the oil, and then redissolved and reprecipitated in MEK to measure turbidity.

The following is the method that I used:

Weigh 25.0 grams of contaminated oil into a 500-ml Erlenmeyer flask and add 375 ml (measured at 70° F.) of methyl ethyl ketone (MEK) prechilled at 50° F. Stir for 15 minutes while maintaining the temperature of the mixture at 50° F. After 15 minutes, quickly filter the solution by vacuum over a 5.5-cm Whatman Grade 2 filter paper, making sure that the liquid level over the filter never builds up higher than 0.25 inches (this prevents some of the wax from adhering to the funnel walls). When all the solution has been filtered, maintain suction on the filter for 10–15 seconds after all the liquid has drained off to ensure that the filter paper is free of oil from the first solution.

Set up another filtration apparatus using a 250-ml filtration flask. Place a clean 8-dram vial in the filtration flask and transfer the wax containing filter paper from the first filtration to the second filtration setup. Pour 23 mils of boiling MEK (175° F.) over the waxy filter with no vacuum and collect all the filtrate in the 8-dram vial. Remove the 8-dram vial and cap tightly with a plastic cap containing a polyethylene cone liner. Insert a second vial into the filter flask and repeat the filter washing with another 23 ml quantity of boiling MEK. (Note: if the first wash was done correctly, the second wash should have negligible wax.)

Place both vials in ice water for three minutes. Remove and allow both vials to come to 68°–72° F. Shake vials vigorously for five to eight seconds and place in a Hach Model 18900 ratio turbidimeter which has been previously calibrated with an 18 NTU formazin standard. Allow 10–15 seconds for the instrument to stabilize and record the average reading at the lowest instrument setting over the next 10 seconds. Measure the turbidity on each vial twice and sum the average readings for the first wash with the average readings with the second wash. (Note: if the second wash was less than 10% of the first wash or less than 1.0 NTU, the first wash was probably done correctly.) Round off to the nearest whole number and report this as the NTU index.

EXAMPLE 1

I carried out a series of experiments in a trickle bed miniature pilot plant to demonstrate the advantages of the present invention. I loaded 0.61 grams of Catalyst A directly over 3.17 grams of Catalyst B into a ⅜-inch stainless steel reactor to give a total volume of 7.47 cc. I filled the remaining dead volume of the reactor with 24–42 mesh inert allundum. I preconditioned the catalysts by passing dry nitrogen in situ at 250° F. and 1000 psig for 30 minutes at a rate of 60 cc/min. I then switched the gas to hydrogen and maintained at 300° F. for one hour. Following this, I pressured the unit to 2150 psig under flowing hydrogen at 60 cc/min. and increased temperature 50° F. every 30 minutes until I reached 550° F. I maintained this for 1.5 hours before I introduced the hydrocarbon feed.

The feed that I used to condition the catalysts was a 900°–1100° F. boiling point, hydrocracked and solvent dewaxed heavy neutral oil, spiked with 130 ppm n-butylamine. Table II gives the inspections for Feed A.

TABLE II

Properties of Heavy Neutral Feeds Used in Examples 1 and 2

| | Feed A |
|---|---|
| Gravity, Spec. @ 20° C. | .8681 |
| Pour Point, °F. | +5 |
| Cloud Point, °F. | |
| Viscosity @ 40° C., cSt | 89.55 |
| Viscosity @ 100° C., cSt | 10.85 |
| Viscosity Index | 105 |
| Sulfur, ppm | 4.56 |
| Nitrogen, ppm | .48 |
| Oxidator BN | |
| NTU Index | 43 |
| TPG Dist., LV%, °F. | |
| St | 746 |
| 5 | 821 |
| 10 | 853 |
| 30 | 915 |
| 50 | 953 |
| 70 | 987 |
| 90 | 1031 |
| 95 | 1055 |
| 99 | 1122 |

I ran Feed A at 4 cc/hr for a period of 12 hours. My purpose of using a butylamine spiked feed during the initial break-in period was to rapidly deactivate and condition the catalysts so that their activity would more closely resemble a catalyst with several hundred hours onstream.

Following this period, I contacted the layered catalyst system with unadulterated Feed A. This demonstrates the system's ability to dehaze 43 NTU wax-contaminated-feed to an acceptable level (below 25 NTU) at space rates of 4.7 to 9.46 $hr.^{-1}$ with respect to Catalyst A. Table III displays my results.

TABLE III

Properties of Hydrofinished Heavy Neutral Oil Using Feed A

| | | | | |
|---|---|---|---|---|
| Hours Onstream | 94 | 113 | 140 | 161 |
| Reactor Temp., °F. | 600 | 600 | 625 | 625 |
| Wt. % Lube Yield | 99.0 | 97.0 | 95.83 | 96.9 |

TABLE III-continued

| Properties of Hydrofinished Heavy Neutral Oil Using Feed A | | | | |
|---|---|---|---|---|
| LHSV/hr (wrt Cat. A) | 4.7 | 9.5 | 4.7 | 9.5 |
| LHSV/hr (overall) | 0.54 | 1.07 | 0.54 | 1.07 |
| NTU Index | 14 | 17 | 1 | 1 |
| Viscosity @ 40° C., cSt | 89.64 | | 86.13 | 87.41 |
| Viscosity @ 100° C., cSt | 10.86 | | 10.60 | 10.70 |

EXAMPLE 2

In this example, I ran Catalyst B alone to demonstrate that a hydrofinishing catalyst by itself is unable to reduce NTU content of a wax-contaminated-feed. Table IV displays my results.

TABLE IV

| Properties of Hydrofinished Heavy Neutral Oil Using Feed A, Catalyst B | | |
|---|---|---|
| Hours Onstream | 64 | 136 |
| Reactor Temp., °F. | 550 | 625 |
| LHSV/hr (overall) | 0.54 | 0.54 |
| Wt. % Lube Yield | 98.9 | 96.9 |
| NTU | 43 | 40 |

What is claimed is:

1. A process for dehazing and hydrofinishing a hydrocracked, solvent dewaxed lube oil base stock which comprises:

passing said stock, in the presence of hydrogen, through a multilayer single stage catalyst system wherein said feed is hydrodehazed and hydrofinished, said catalyst system comprising:

(a) a first catalyst layer comprising a fixed bed of catalyst particles having dehazing activity, said catalyst comprising a silica aluminophosphate (SAPO) molecular sieve having a pore probe selectivity greater than 4 wherein said pore probe selectivity is the ratio of the weight of normal hexane to combine weight of 3-methylpentane and 2,2-dimethylbutane in the molecular sieve pore system per gram of catalyst; and (b) a second catalyst layer in contact with said first catalyst layer comprising a fixed bed of catalyst particles having hydrogenation activity under hydrofinishing conditions, under hydrodehazing and hydrofinishing conditions, and obtaining a product having a nephelometric turbidity units (NTU) index of 24 or less wherein said nephelometric turbidity units (NTU) index is a measure of wax remaining in the oil after solvent dewaxing.

2. A process according to claim 1 wherein said hydrodehazing and hydrofinishing conditions comprise:

(a) a space velocity (LHSV) greater than 4; and (b) a hydrogen partial pressure greater than 500 psia.

3. A process according to claim 2 wherein said hydrodehazing and hydrofinishing conditions comprise:

(a) a space velocity (LHSV) ranging from about 10 to about 15;

(b) a hydrogen partial pressure ranging from about 1000 psia to about 2500 psia;

(c) a hydrogen circulation rate ranging from about 5000 to about 7000 standard cubic feet per barrel of feed (SCF/bbl);

(d) a temperature ranging from about 550° F. to about 650° F.; and (e) a pressure ranging from about 1500 psig to about 3000 psig.

4. A process according to claim 3 wherein said hydrocracked solvent dewaxed lube oil base stock comprises a sulfur level of less than 20 ppm and a nitrogen level of less than 20 ppm.

5. The process according to claim 1 wherein the catalyst of said first layer comprises a silica aluminophosphate having a pore probe selectivity ranging from about 15 to 70.

6. The process according to claim 1 wherein the catalyst of said first layer comprises a hydrogenation component selected from the Group VIII or Group VI metals.

7. The process according to claim 1 wherein said first layer molecular sieve dehazing catalyst comprises SAPO-11.

8. The process according to claim 1 wherein the catalyst of said second layer comprises at least one Group VIIIA noble metal supported on an alumina or siliceous matrix.

9. The process according to claim 8 wherein said noble metal is palladium.

* * * * *